US007694825B1

(12) United States Patent
Md Sulamin

(10) Patent No.: US 7,694,825 B1
(45) Date of Patent: Apr. 13, 2010

(54) CARRIER TAPE FOR ELECTRONIC COMPONENTS

(75) Inventor: Mohd Razif Md Sulamin, Puchong (MY)

(73) Assignee: Freescale Semiconductor, Inc., Austin, TX (US)

( * ) Notice: Subject to any disclaimer, the term of this patent is extended or adjusted under 35 U.S.C. 154(b) by 0 days.

(21) Appl. No.: 12/275,222

(22) Filed: Nov. 21, 2008

(51) Int. Cl.
*B65D 85/00* (2006.01)

(52) U.S. Cl. ..... 206/714; 206/726

(58) Field of Classification Search ..... 206/713, 206/714, 701, 710, 716, 722, 726
See application file for complete search history.

(56) References Cited

U.S. PATENT DOCUMENTS 5,492,223 A 2/1996 Boardman et al.
5,872,458 A 2/1999 Boardman et al.
7,061,108 B2 6/2006 Wright et al.
2003/0085150 A1* 5/2003 Yen ..... 206/714
2003/0106833 A1* 6/2003 Chen et al. ..... 206/714
2004/0040886 A1* 3/2004 Tellkamp et al. ..... 206/714
2006/0157382 A1* 7/2006 Yasufuku et al. ..... 206/714

* cited by examiner

*Primary Examiner*—Jacob K Ackun, Jr.
(74) *Attorney, Agent, or Firm*—Charles Bergere

(57) ABSTRACT

A carrier tape (10) for electronic components or devices (44) includes a tape body (12) and a plurality of pockets (14) formed in the tape body (12). Each of the pockets (14) includes a sidewall (18) and a base portion (20). The base portion (20) joins the sidewall (18) at an edge portion (22). A protrusion (24) is formed in the base portion (20) of the pocket (14). The protrusion (24) is configured to maintain a separation between the edge portion (22) and a surface on which the pocket (14) rests.

8 Claims, 2 Drawing Sheets

CARRIER TAPE FOR ELECTRONIC COMPONENTS

BACKGROUND OF THE INVENTION

The present invention relates to the handling of electronic components and more particularly to a carrier tape for electronic components.

It is known to ship electronic components in carrier tapes. A problem that often arises when electronic components are shipped in conventional carrier tapes is mechanical damage to the leads of the components during transportation or as a result of mishandling.

Consequently, a need exists for a carrier tape that is capable of transporting electronic components more securely and that provides greater protection against damage resulting from mishandling.

BRIEF DESCRIPTION OF THE DRAWINGS

The following detailed description of a preferred embodiment of the invention will be better understood when read in conjunction with the appended drawings. The present invention is illustrated by way of example and is not limited by the accompanying figures, in which like references indicate similar elements. It is to be understood that the drawings are not to scale and have been simplified for ease of understanding the invention.

DETAILED DESCRIPTION OF THE INVENTION

Figure 1:
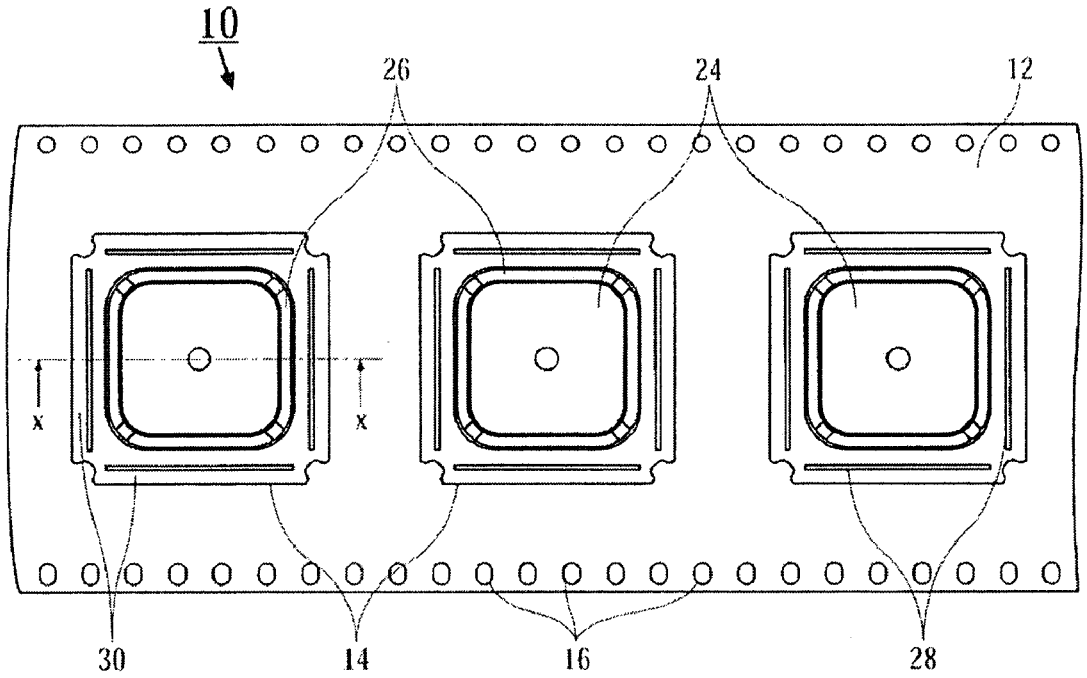
FIG. 1 is an enlarged top plan view of a portion of a carrier tape in accordance with an embodiment of the present invention.

The detailed description set forth below in connection with the appended drawings is intended as a description of the presently preferred embodiment of the invention, and is not intended to represent the only form in which the present invention may be practiced. It is to be understood that the same or equivalent functions may be accomplished by different embodiments that are intended to be encompassed within the spirit and scope of the invention. In the drawings, like numerals are used to indicate like elements throughout.

The present invention provides a carrier tape for electronic components. The carrier tape includes a tape body and a plurality of pockets formed in the tape body. Each of the pockets includes a sidewall and a base portion that joins the sidewall at an edge portion. A protrusion is formed in the base portion of the pocket. The protrusion is configured to maintain a separation between the edge portion and a surface on which the pocket rests.

The present invention also provides a carrier tape including a tape body and a plurality of pockets formed in the tape body. Each of the pockets includes a sidewall and a base portion that joins the sidewall at an edge portion. A protrusion extends from the base portion outwards of the pocket.

The present invention further provides a carrier tape including a tape body and a plurality of pockets formed in the tape body. Each of the pockets includes a sidewall and a base portion that joins the sidewall at an edge portion. A protrusion extends from the base portion outwards of the pocket. A support element is formed in the base portion of the pocket and is arranged to restrict lateral movement of an electronic component received in the pocket.

Referring now to FIG. 1, a portion of a carrier tape 10 for electronic components is shown. The carrier tape 10 includes a tape body 12 and a plurality of recesses or pockets 14 formed in the tape body 12 extending downwardly from the tape body 12. In the embodiment shown, a plurality of perforations 16 is formed along respective edges of the tape body 12.

The tape body 12 may comprise a conductive or non-conductive polystyrene (PS), polycarbonate (PC), polyvinyl chloride (PVC) or polyethylene terephthalate (PET) tape and may have a width of between about 8 millimeters (mm) and about 88 mm and a thickness of between about 0.2 mm and about 0.5 mm. It should however be understood that the present invention is not limited by the material from which the carrier tape 10 is formed or by the dimensions of the tape body 12.

In the embodiment shown, multiple pockets 14 are formed at intervals along a length of the tape body 12 and one (1) pocket 14 is provided across the width of the tape body 12. Nonetheless, as will be understood by those of skill in the art, the present invention is not limited by the arrangement of the pockets 14 or the number of pockets 14 in the tape body 12. For example, more than one pocket 14 may be formed across the width of the tape body 12 in an alternative embodiment.

The pockets 14 may be formed in the tape body 12 using known methods such as, for example, air-pressure forming, vacuum forming or female-/male-type forming. Accordingly, further description of the formation of the pockets 14 in the tape body 12 is not required for a complete understanding of the present invention.

Electronic components such as, for example, Quad Flat Packages (QFPs), Low-profile Quad Flat Packages (LQFPs), Shrink Small Outline Packages (SSOPs), Thin Shrink Small Outline Packages (TSSOPs) and Small Outline Integrated Circuit (SOIC) packages may be received in the pockets 14. As will be understood by those of skill in the art, the present invention can accommodate various types of electronic components of various dimensions, and the pockets 14 of the carrier tape 10 are accordingly sized. For example, the pockets 14 may be sized to a dimension of about 17 mm by 17 mm by 2 mm to receive LQFPs measuring about 14 mm by 14 mm by 1.4 mm or to a dimension of about 23 mm by 23 mm by 2 mm to receive LQFPs measuring about 20 mm by 20 mm by 1.4 mm.

Figure 2:
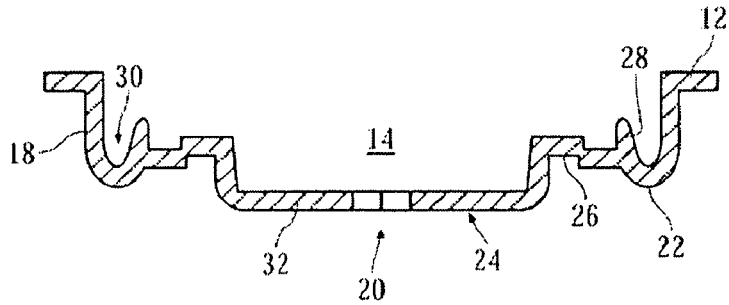
FIG. 2 is an enlarged cross-sectional view of one of the pockets of the carrier tape taken along a line X-X of FIG. 1.

Referring now to FIG. 2, an enlarged cross-sectional view of one of the pockets 14 of the carrier tape 10 taken along a line X-X of FIG. 1 is shown. As can be seen from FIG. 2, the pocket 14 comprises a sidewall 18 and a base portion 20. The base portion 20 joins the sidewall 18 at a lower end thereof at an edge portion 22. The edge portion 22 may be square, as shown, chamfered, curved or otherwise as required or desired. A protrusion 24 is formed in the base portion 20 of the pocket 14. The protrusion 24 extends further downwardly, or outwardly, of the pocket 14; that is, the protrusion 24 extends away from an inner surface of the pocket 14. In the embodiment shown, a pedestal 26 and a support element 28 are formed in the base portion 20 of the pocket 14. The support element 28 is formed between the sidewall 18 and the pedestal 26. The sidewall 18 and the support element 28 define a trough 30 therebetween for accommodating leads of an electronic component (not shown) received in the pocket 14.

In the present embodiment, the protrusion 24 extends from a substantially central portion of the pocket and has a substantially planar base surface 32. The protrusion 24 serves to maintain a separation between the edge portion 22 of the pocket 14 and a surface (not shown) on which the pocket 14 rests. In one embodiment, the protrusion 24 may be formed by extending the base portion 20 further downwardly of the pocket 14 using a known method such as, for example, air pressure forming, vacuum forming or female/male type forming. In one embodiment, the protrusion may be configured to maintain a separation distance of between about 0.25 mm and about 0.30 mm between the edge portion 22 of the pocket 14 and the surface on which the pocket 14 rests. It should however be understood by those of skill in the art that the present invention is not limited by the shape or dimensions of the protrusion 24.

The pedestal 26 is arranged to support a body of the electronic component received in the pocket 14. In one embodiment, the pedestal 26 may be formed by elevating the base portion 24 upwardly of the pocket 14 using a known method such as, for example, air pressure forming, vacuum forming or female/male type forming and to a height of between about 0.5 mm and about 0.7 mm. It should however be understood by those of skill in the art that the present invention is not limited by the dimensions of the pedestal 26.

The support element 28 is arranged to provide lateral support to the electronic component received in the pocket 14 and may be provided in the form of fences or ridges. In one embodiment, the support element 28 may be formed to a height of between about 0.3 mm and about 0.5 mm. It should however be understood by those of skill in the art that the present invention is not limited by the dimensions of the support element 28.

Referring again to FIG. 1, the pedestal 26 in the embodiment shown extends as a complete frame along a periphery of the pocket 14, but may be discontinuous in alternative embodiments. The support element 28 extends along the sides, but not the corners, of the pocket 14. Nonetheless, as will be understood by those of skill in the art, the present invention is not limited by the layout or configuration of the pedestal 26 or the support element 28.

The perforations 16 along respective edges of the tape body 12 may be provided for feeding and/or indexing purposes. The perforations 16 may be formed in the tape body 12 using known methods such as, for example, punch cutting. Each of the perforations 16 may have a diameter of between about 1.5 mm and about 1.6 mm and a separation of between about 3.9 mm and about 4.1 mm between adjacent ones of the perforations 16. As carrier tape perforations are well known in the art, further description thereof is not required for a complete understanding of the present invention.

In use, an electronic component is inserted into a pocket 14 of the carrier tape 10 and a cover tape (see, for example, cover tape 50 in FIG. 4 described below) is attached to the tape body 12, for example, at the edges, to seal the electronic components in the pockets 14. Thereafter, the carrier tape 10 is wound on a reel (see, for example, reel 36 in FIG. 3 described below) for transportation.

Figure 3:
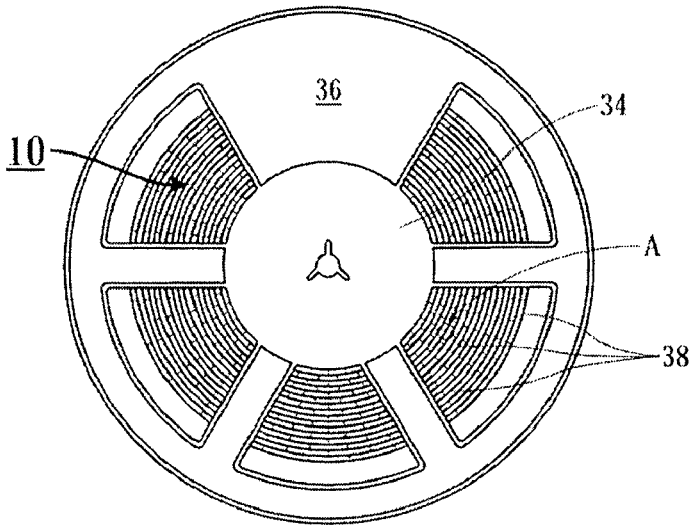
FIG. 3 is a top plan view of the carrier tape of FIG. 1 wound around a hub of a reel.

Referring now to FIG. 3, a top plan view of the carrier tape 10 of FIG. 1 wound around a hub 34 of a reel 36 is shown. As shown in FIG. 3, the carrier tape 10 is wound around the hub 34 thereby forming a plurality of layers 38 around the hub 34.

The reel 36 may be any suitable commercially available supply reel for use with carrier tapes.

Figure 4:
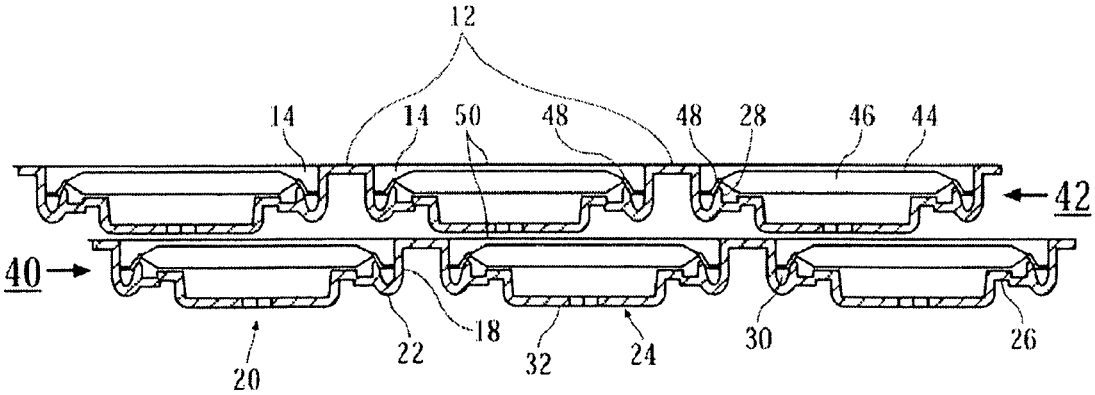
FIG. 4 is an enlarged view of an encircled portion A of the wound carrier tape of FIG. 3.

Referring now to FIG. 4, an enlarged view of an encircled portion A of the wound carrier tape 10 of FIG. 3 is shown. More particularly, FIG. 4 shows two (2) layers 40 and 42 of pockets 14 around the hub 34 of the reel 36. The first 40 of the two layers 40 is being located closer to the hub 34 than the second layer 42. As shown in FIG. 4, a plurality of integrated circuit devices 44 is received in respective ones of the pockets 14. Each of the devices 44 includes a body 46 and a plurality of leads 48 that extend outwardly from sides of the body 46. A cover tape 50 is attached to the carrier tape 10 to hold the devices 44 in the pockets 14 of the carrier tape 10. In one embodiment of the invention, the cover tape 50 seals the devices 44 in the pockets 14.

The devices 44 in the embodiment shown may be QFPs, LQFPs, SSOPs, TSSOPs, SOIC packages or other types of leaded packages. Nevertheless, although FIG. 4 shows devices 44 with gull-wing type leads 48 contained in the pockets 14 of the carrier tape 10, it should be understood by those of skill in the art that the present invention is not limited to carrying particular package types or only assembled packages. The present invention may, for example, be used to transport non-leaded packages, leaded packages with J-type leads or integrated circuit (IC) dice in alternative embodiments. Further, as previously mentioned, the present invention can accommodate electronic components of various sizes, as will be understood by those of skill in the art. As an example, the devices 44 in present embodiment may measure about 14 mm by 14 mm by 1.4 mm or about 20 mm by 20 mm by 1.4 mm.

The bodies 46 of the devices 44 are supported on the pedestals 26 formed in respective ones of the pockets 14. The leads 48 of the devices 44 are supported on the support elements 28 formed in respective ones of the pockets 14, in particular, the support elements 28 nest under the portion of the leads 48 immediately adjacent the bodies 46 of the devices 44. The ends of the leads 48 extend into the troughs 30 defined between the sidewalls 18 of the pockets 14 and the support elements 28. In a preferred embodiment, the support elements 28 are shaped and arranged to engage the leads 48 of the devices 44 such that lateral movement of the devices 44 within the pockets 14 is restricted. As shown, the support elements 28 are angled inwardly to support the leads 48. The angle of the support elements 28 may approximate the angle of the leads 48. The support elements 28 may also be arranged to isolate the leads 48 from the sidewalls 18 of the pockets 14. This helps to protect the leads 48 from mechanical damage during handling and transportation.

The cover tape 50 may be any known and commercially available tape for sealing component-holding parts of a carrier tape, and may be attached to the carrier tape 10 using known attachment methods. Accordingly, further description of the cover tape 50 and of its attachment to the carrier tape 10 is not required for a complete understanding of the present invention.

The protrusions 24 on the base of the pockets 14 serve a dual purpose. Firstly, the protrusions 24 serve to inhibit displacement of the devices 44, against which the protrusions 24 are positioned, outside of the pockets 14 in which the devices 44 are received. Secondly, the protrusions 24 serve to protect the edge portions 22 of the pockets 14, on or adjacent to which the leads 48 rest, from damage.

Consequently, in the event the carrier tape 10 is impacted, for example, during transportation or as a result of mishandling, the protrusions 24 act to clamp on or press against the devices 44 of an adjacent layer 40 of pockets 14 that are adjacent to the protrusions 24. This prevents or at least reduces the incidence of electronic components slipping out of the pockets 14 of the carrier tape 10 and lead damage as a result during handling and transportation.

Further, when impacted, the protrusions 24 absorb the force of the impact, and because of the separation provided by the protrusions 24 between the edge portions 22 of the pockets 14 and the surface on which the pockets 14 rest, the edge portions 22 of the pockets 14 and thus the leads 48 of the devices 44 resting on or adjacent the edge portions 22 are less likely to be impacted. This prevents or at least reduces damage to the leads 48 during handling and transportation.

Advantageously in the present embodiment, the combination of the support elements 28 which restrict lateral movement of the devices 44 in the pockets 14 and the clamping and buffering effect provided by the protrusions 24 serves to effectively reduce damage to the devices 44 and particularly, its leads 48 during handling and transportation.

Although FIG. 4 shows only one (1) semiconductor device 44 in each of the pockets 14 of the carrier tape 10, it will be understood that the present invention is not limited to carrying only one electronic component in each pocket of the carrier tape; more than one electronic component may be received in each pocket of the carrier tape in alternative embodiments.

As is evident from the foregoing discussion, the present invention provides a carrier tape for electronic components. Advantageously, the protrusions on the base portions of the pockets of the carrier tape provide a clamping and buffering effect that substantially protects electronic components, in particular, the leads of semiconductor devices, housed and transported in the carrier tape during handling and transportation, preventing or at least reducing mechanical damage to the lead tips, the lead finishes or the assembled packages and thereby enabling substantially secure shipping of electronic components via the carrier tape.

The description of a preferred embodiment of the present invention has been presented for purposes of illustration and description, but is not intended to be exhaustive or to limit the invention to the forms disclosed. It will be appreciated by those skilled in the art that changes could be made to the embodiments described above without departing from the broad inventive concept thereof. It is understood, therefore, that this invention is not limited to the particular embodiments disclosed, but covers modifications within the spirit and scope of the present invention as defined by the appended claims.

The invention claimed is:

1. A carrier tape for electronic components, comprising:
a tape body; and
a plurality of pockets formed in the tape body, wherein each of the pockets comprises:
a sidewall,
a base portion joining the sidewall at an edge portion, and
a protrusion formed in the base portion of the pocket and configured to maintain a separation between the edge portion and a surface on which the pocket rests,
wherein each of the pockets further comprises:
a support element formed in the base portion of the pocket that is shaped and arranged to engage leads of the electronic component received in the pocket, to isolate leads of the electronic component from the sidewall of the pocket, and to provide lateral support to an electronic component received in the pocket; and
a pedestal formed in the base portion of the pocket and arranged to support a body of an electronic component received in the pocket.

2. The carrier tape for electronic components of claim 1, wherein the protrusion extends outwardly from the pocket.

3. The carrier tape for electronic components of claim 1, wherein the protrusion is configured to maintain a separation distance of between about 0.25 millimeters (mm) and about 0.30 mm between the edge portion and the surface on which the pocket rests.

4. The carrier tape for electronic components of claim 1, wherein the protrusion extends from a central portion of the pocket.

5. A carrier tape for electronic components, comprising:
a tape body; and
a plurality of pockets formed in the tape body, wherein each of the pockets comprises:
a sidewall,
a base portion joining the sidewall at an edge portion of the sidewall, wherein the base portion is substantially perpendicular to the sidewall,
a protrusion extending from the base portion outwards of the pocket,
a support element formed in the base portion of the pocket between the protrusion and the sidewall, wherein the support element is substantially perpendicular to the protrusion and wherein a trough is formed between the support element and the side wall, the trough being sized and shaped to accommodate leads of an electronic component received in the pocket and to isolate said leads from the sidewall of the pocket, and
a pedestal formed in the base portion of the pocket between the protrusion and the support element, and arranged to support a body of the electronic component received in the pocket.

6. The carrier tape for electronic components of claim 5, wherein the protrusion is configured to maintain a separation distance of between about 0.25 mm and about 0.30 mm between a surface on which the pocket rests and the edge portion where the sidewall and the base portion of the pocket meet.

7. The carrier tape for electronic components of claim 5, wherein the protrusion extends from a central portion of the pocket.

8. A carrier tape for electronic components, comprising:
a tape body; and
a plurality of pockets formed in the tape body, wherein each of the pockets comprises:
a sidewall,
a base portion that joins the sidewall at an edge portion of the sidewall, wherein the base portion is substantially perpendicular to the sidewall,
a protrusion extending from the base portion outwards of the pocket, wherein the protrusion is substantially perpendicular to the sidewall,
a support element formed in the base portion of the pocket and arranged to restrict lateral movement of an electronic component received in the pocket, wherein the support element is located between the protrusion and the sidewall and is substantially perpendicular to the protrusion, and wherein a trough is formed between the support element and the sidewall, the trough being sized and shaped to accommodate leads of the electronic component received in the pocket and to isolate said leads from the sidewall, and
a pedestal formed in the base portion of the pocket between the protrusion and the support element, and arranged to support a body of the electronic component received in the pocket,
wherein the protrusion is configured to maintain a separation distance of between about 0.25 mm and about 0.30 mm between a surface on which the pocket rests and the edge portion where the sidewall and the base portion of the pocket meet.

* * * * *